US007312768B2

(12) United States Patent
Kang et al.

(10) Patent No.: US 7,312,768 B2
(45) Date of Patent: Dec. 25, 2007

(54) PANEL DRIVING METHOD AND APPARATUS FOR REPRESENTING GRADATION USING ADDRESS-SUSTAIN MIXED INTERVAL

(75) Inventors: Kyoung-Ho Kang, Suwon-si (KR); Woo-Joon Chung, Asan-si (KR); Jin-Sung Kim, Cheonan-si (KR); Seung-Hun Chae, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 674 days.

(21) Appl. No.: 10/916,520

(22) Filed: Aug. 12, 2004

(65) Prior Publication Data

US 2005/0035935 A1 Feb. 17, 2005

(30) Foreign Application Priority Data

Aug. 13, 2003 (KR) ..... 10-2003-0056005

(51) Int. Cl.
*G09G 3/28* (2006.01)

(52) U.S. Cl. ..... 345/63; 345/60; 345/68; 345/89; 345/690

(58) Field of Classification Search ..... 345/60–68, 345/89–95, 690; 315/169.1–169.4
See application file for complete search history.

(56) References Cited

U.S. PATENT DOCUMENTS

| | | | | |
|---|---|---|---|---|
| 5,541,618 | A | 7/1996 | Shinoda | 345/60 |
| 6,084,558 | A * | 7/2000 | Setoguchi et al. | 345/60 |
| 6,172,465 | B1 * | 1/2001 | Huang | 315/169.3 |
| 6,252,574 | B1 * | 6/2001 | Hosoi et al. | 345/103 |

FOREIGN PATENT DOCUMENTS

| | | |
|---|---|---|
| JP | 07-191627 | 7/1995 |
| JP | 08-044315 | 2/1996 |
| JP | 11-065516 | 3/1999 |
| JP | 2001-005424 | 1/2001 |
| JP | 2002-140032 | 5/2002 |
| JP | 2002-175761 | 6/2002 |

* cited by examiner

*Primary Examiner*—Vijay Shankar
(74) *Attorney, Agent, or Firm*—H.C. Park & Associates, PLC

(57) ABSTRACT

A method for driving a panel includes classifying cells on the panel into a plurality of cell groups and performing an addressing and a sustain discharge on cells included in each of the cell groups using address electrodes, scan electrodes, and common electrodes on the panel; dividing a frame period into a plurality of subfields, allocating different gray scales to the plurality of subfields, respectively, and selectively driving the subfields to represent gradation of visible brightness of the cells on the panel; and sequentially performing an address period and a sustain period on the cell groups in at least one subfield. After the address period is performed on cells included in a cell group, the sustain period is performed on the cells included in the cell group. After the sustain period is completed on one cell group, the address period is performed on another cell group. While the sustain period is performed on one cell group, the sustain period may be selectively performed on other cell groups on which the address period has been performed. Bias voltages applied to the common electrodes while the address period is sequentially performed on the cell groups are different among the cell groups.

22 Claims, 9 Drawing Sheets

FIG. 4

| SUBFIELD NUMBER | 1 | 2 | 3 | 4 | 5 | 6 | 7 | 8 |
|---|---|---|---|---|---|---|---|---|
| GRAY SCALE / ELECTRODE | 1 | 2 | 4 | 8 | 16 | 32 | 64 | 128 |
| $G_1$ | $Y_{11}$ $Y_{12}$ ... | | | | | | | |
| $G_2$ | $Y_{21}$ $Y_{22}$ ... | | | | | | | |
| ... | ... | | | | | | | |
| $G_n$ | $Y_{n1}$ $Y_{n2}$ ... | | | | | | | |

PANEL DRIVING METHOD AND APPARATUS FOR REPRESENTING GRADATION USING ADDRESS-SUSTAIN MIXED INTERVAL

This application claims the benefit of Korean Patent Application No. 2003-56005, filed on Aug. 13, 2003, which is hereby incorporated by reference for all purposes as if fully set forth herein.

BACKGROUND OF THE INVENTION

1. Field of the Invention

The present invention relates to a method and apparatus for displaying an image by sequentially performing an address period and a sustain period.

2. Discussion of the Related Art

U.S. Pat. No. 5,541,618 discloses an electrode driving method for a PDP. Panel driving timing is divided into a reset (i.e., initialization) period, an address (i.e., write) period, and a sustain (i.e., display) period. During the reset period, each cell is initialized to efficiently perform addressing. During the address period, cells to be turned on and off are selected, and wall charges accumulate in the cells to be turned on. During the sustain period, the addressed cells perform discharges to display an image.

In the method disclosed in U.S. Pat. No. 5,541,618, the address period and the sustain period are separated from, and independent of, each other in a time domain that represents gradation in a field-subfield structure. In other words, after addressing is sequentially performed on all scan electrodes, the sustain period is simultaneously executed for all of the cells. According to the method, a sustain discharge in a previously addressed scan line is executed only after all scan lines have been addressed. Accordingly, when gradation is represented using the conventional method, a temporal gap between a cell's addressing and sustain discharges may occur, which may destabilize the sustain discharge.

SUMMARY OF THE INVENTION

The present invention provides a panel driving method and apparatus for minimizing a temporal gap between an address period and a sustain period.

Additional features of the invention will be set forth in the description which follows, and in part will be apparent from the description, or may be learned by practice of the invention.

The present invention discloses a method of driving a display apparatus comprising classifying cells on a panel into a plurality of cell groups, dividing a frame period into a plurality of subfields, and sequentially performing an address period and a sustain period on the cell groups in at least one subfield. After the address period is performed on cells included in a cell group, the sustain period is performed on the cells included in the cell group. After that sustain period is completed on the cell group, the address period is performed on another cell group. While the sustain period is performed on a cell group, it may also be selectively performed on other cell groups on which the address period has been performed. This present invention also discloses a method of driving a display apparatus comprising classifying cells on a panel into a plurality of cell groups, dividing a frame period into a plurality of subfields, and driving each cell group using a different common electrode group. An address period and a sustain period are sequentially performed on the cell groups in at least one subfield. After the address period is performed on cells included in a cell group, the sustain period is performed on the cells included in the cell group. After the sustain period is completed on the cell group, another address period is performed on another cell group. While the sustain period is performed on one cell group, it may also be selectively performed on other cell groups on which the address period has been performed.

This present invention also discloses a method of driving a panel comprising classifying cells on the panel into a plurality of cell groups, dividing a frame period into a plurality of subfields, and driving the cell groups using different common electrode groups, respectively. An address period and a sustain period are sequentially performed on the cell groups in at least one subfield. After the address period is performed on cells included in a cell group, the sustain period is performed on those cells, and after the sustain period is completed, a subsequent address period is performed on another cell group. While the sustain period is performed on one cell group, it may also be selectively performed on other cell groups on which the address period has been performed. Different bias voltages may be applied to the common electrode groups, respectively, while the address period is sequentially performed on the cell groups The present invention also discloses a panel driving apparatus that performs an addressing and a sustain discharge on a panel including a plurality of scan electrode groups and one or more common electrode groups. The panel driving apparatus includes a subfield processor dividing a frame period into a plurality of subfields; a signal combiner generating an address signal to selectively address cells to be turned on among all cells on the panel in a subfield and generating a sustain signal to perform a sustain discharge in addressed cells; and an electrode driver selectively driving the subfields according to the address signal and the sustain signal and driving each of cell groups, into which the cells on the panel are classified, to determine a gray scale of brightness of the cells on the panel. The signal combiner sequentially performs an address period and a sustain period on each cell group and generates the address signal and the sustain signal such that while cells included in one cell group are addressed, cells included in the other cell groups are in an idle state and such that while the sustain period is performed on cells included in one cell group after being addressed, the sustain period is selectively performed on cells included in other cell groups having been addressed. The electrode driver applies different bias voltages for the respective cell groups to the one or more common electrode groups while the address period is sequentially performed on the cell groups.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIG. 4 shows a method of representing gradation in a single frame using a plurality of subfields.

DETAILED DESCRIPTION OF THE ILLUSTRATED EMBODIMENTS

Figure 1:
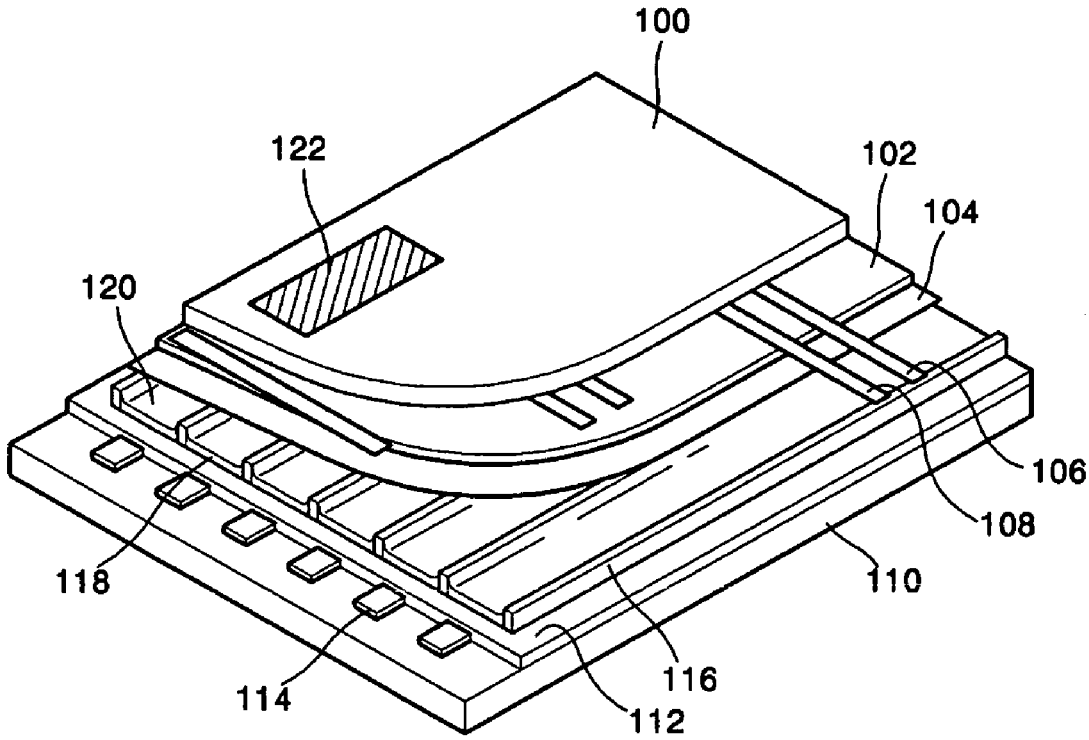
FIG. 1 is a partial perspective view of an alternating current (AC) type plasma display panel (PDP) to which exemplary embodiments of the present invention may be applied.

Hereinafter, preferred embodiments of the present invention will be described in detail with reference to the attached drawings. Like reference numerals in the drawings denote like elements. In the embodiments described below, an alternating current (AC) type plasma is display panel (PDP) is used to describe a display apparatus for which the present invention may pertain to. However, the present invention is not limited to an AC type PDP because it may be applied to other types of displays.

FIG. 1 is a partial perspective view of an AC type PDP to which the present invention may be applied. Scan electrodes 106 and sustain (i.e., common) electrodes 108 are formed in parallel pairs on a first glass substrate 100 and covered with a dielectric layer 102 and a protective layer 104. A plurality of address electrodes 114, arranged orthogonally to them, are formed on a second glass substrate 110 and covered with an insulating layer 112. Partition walls 116 are formed on the insulating layer 112 between address electrodes 114 to be parallel to the address electrodes 114. Phosphor layers 118 are formed on a surface of the insulating layer 112 and sidewalls of the partition walls 116. The first glass substrate 100 and the second glass substrate 110 face each other with discharge areas 120 therebetween. The discharge areas 120 are formed by the scan electrodes 106, the common electrodes 108, the address electrodes 114, and the partition walls 116. An intersection of an address electrode 114 and a scan electrode 106 and a common electrode 108 pair defines a discharge cell 122.

Figure 2:
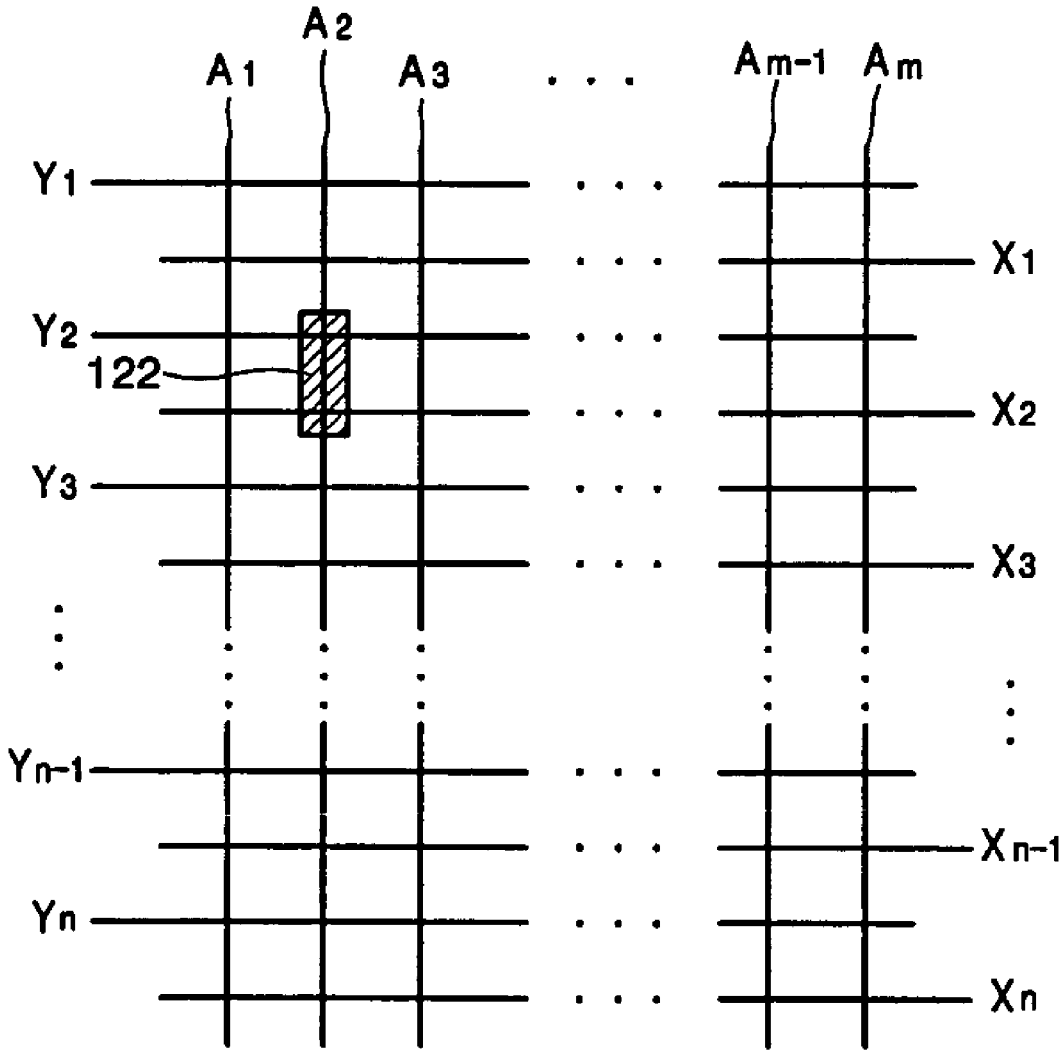
FIG. 2 shows a typical electrode arrangement for an AC type PDP.

FIG. 2 illustrates an arrangement of electrodes on a panel to which the present invention may be applied. The electrodes are structured in an m×n matrix. Address electrodes $A_1$ through $A_m$ are arranged in columns. Scan electrodes $Y_1$ through $Y_n$ and common electrodes $X_1$ through $X_n$ are arranged in rows. Discharge cell 122 is formed at the intersection of the address electrode $A_2$, the scan electrode $Y_2$, and the common electrode $X_2$. Address electrodes and scan electrodes are used to select cells for discharging, and scan electrodes and common electrodes are used to perform discharging.

Figure 3:
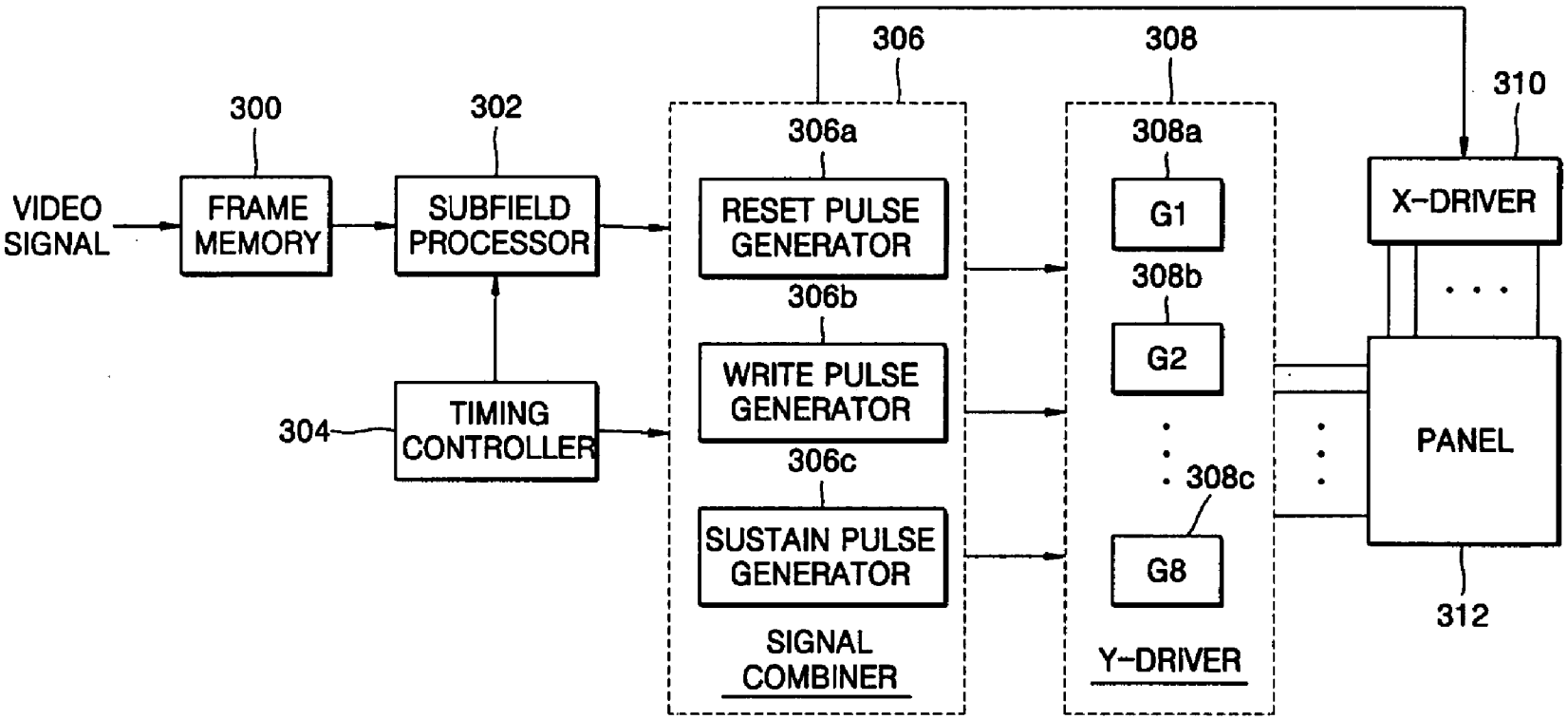
FIG. 3 is a block diagram of a panel driving apparatus according to an exemplary embodiment of the present invention.

FIG. 3 is a block diagram of a panel driving apparatus according to an exemplary embodiment of the present invention. Digital data derived from an external video signal is recorded in a frame memory 300. A subfield processor 302 divides the digital data and outputs the divided data in units of subfields. For example, subfield processor 302 divides one frame of cell data into a plurality of subfields and outputs each subfield's data.

A signal combiner 306 includes a reset pulse generator 306*a*, a write pulse generator 306*b*, and a sustain pulse generator 306*c*, which generate signal waveforms for an address electrode, a scan electrode, and a common electrode, respectively. These signal waveforms drive the address, scan, and common electrodes during a reset period, an address period, and a sustain period. The reset pulse generator 306*a* generates a reset signal for initializing a cell. The write pulse generator 306*b* generates an address signal for selecting cells to be turned on and cells to be turned off and for addressing the cells. The sustain pulse generator 306*c* generates a sustain signal for discharging cells addressed by the address signal. Signals generated by the signal combiner 306 are applied to a Y-driver 308 and an X-driver 310, which drive scan electrodes and common electrodes, respectively, according to predetermined timing.

The scan electrodes are divided into a plurality of groups, and the Y-driver 308 includes a plurality of driving circuits 308*a* through 308*h* to drive the scan electrodes by groups. The number of groups may vary, and the number of driving circuits to drive the scan electrodes may be determined by the number of groups. The X-driver 310 drives the common electrodes. A timing controller 304 generates various timing signals for operating the subfield processor 302 and the signal combiner 306.

Panel driving methods according to exemplary embodiments of the present invention described below may be performed in the structure and by the apparatus shown in FIG. 1, FIG. 2 and FIG. 3.

FIG. 4 illustrates a method of representing gradation in a single frame using a plurality of sub fields. A single frame period corresponding to a single picture is divided into a plurality of subfields to which different gray scales are allocated. Selectively operating one or more subfields may accomplish desired gradation. A visibly bright gray scale is proportional to the number of sustain pulses applied to cells during a single frame period. In other words, a single frame period corresponding to a single picture is divided into a plurality of subfields in a time domain, and different numbers of sustain pulses may be allocated to the subfields. A gray scale is determined by selectively operating subfields, thereby accumulating their allocated sustain pulses.

Referring to FIG. 4, to accomplish a 256 gray scale display, a single frame period is usually divided into 8 subfields to which a ratio of 1, 2, 4, 8, 16, 32, 64 and 128 sustain pulses are sequentially allocated. Sustain periods are also allocated to the 8 subfields in rough proportion to the ratio. In this situation, when cells are addressed and provoked to perform a sustain discharge during a subfield 1 period and a subfield 5 period, brightness corresponding to a gray level of 17 is obtained.

The gray scales allocated to the 8 subfields may change in light of gamma or panel characteristics. For example, a gray scale allocated to a subfield 4 may be lowered from 8 to 6, and a gray scale allocated to a subfield 6 may be raised from 32 to 34. Additionally, a single frame is not required to have 8 subfields because numbers of subfields may vary with design specification.

To implement the present invention, discharge cells are classified into a plurality of groups and be controlled as groups. In an AC PDP, scan electrodes are classified into a is plurality of groups in a predetermined manner. Referring to FIG. 4, scan electrodes are classified into "n" groups $G_1$ through $G_n$.

Figure 5:
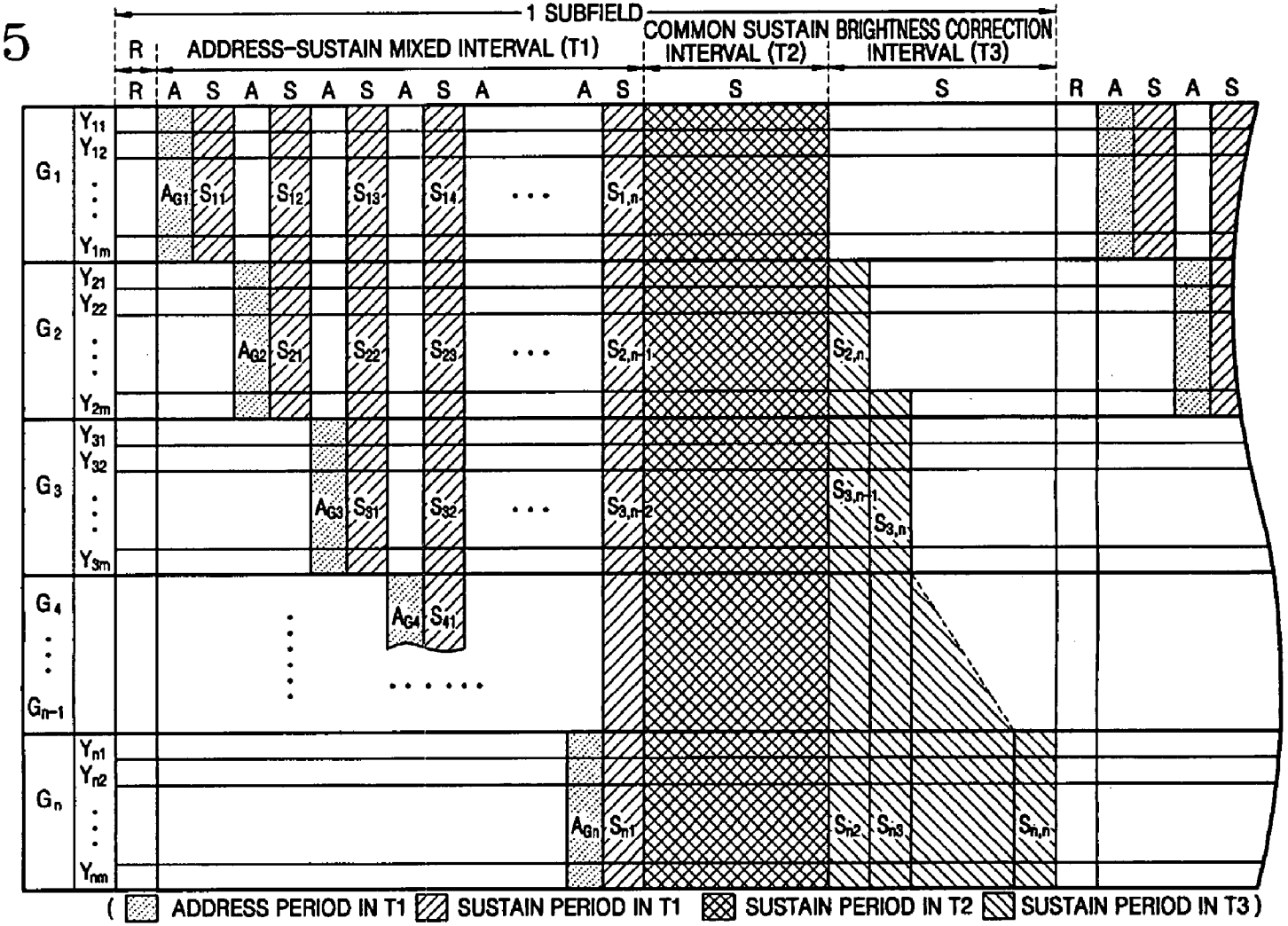
FIG. 5 is a schematic conceptual diagram illustrating a panel driving method using an address-sustain mixed interval according to an exemplary embodiment of the present invention.

FIG. 5 is a schematic conceptual diagram illustrating a panel driving method using an address-sustain mixed interval according to an exemplary embodiment of the present invention. A single frame period is divided into a plurality of subfields, e.g., 8 subfields as shown in FIG. 4, to which different gray scales are allocated. Referring to FIG. 5, cells on a panel are classified into a plurality of groups in a single subfield, and the groups are independently subject to an address operation and a sustain discharge operation.

Scan electrodes are classified into groups $G_1$ through $G_n$. Addressing is sequentially performed on scan electrodes included in each of the groups of $G_1$ through $G_n$. After a group is finished with the addressing, a sustain discharge pulse is applied to scan electrodes included in the group to perform a sustain period. While the sustain period is performed on scan electrodes included in one group, the sustain period may also be performed on scan electrodes of another previously addressed group. As such, immediately after an address period is performed on cells in one group, the sustain period is performed on the same cells, and then a subsequent address period is performed on scan electrodes included in another group that has not been addressed. Scan electrode groups are not required to have the same number of electrodes.

Referring to FIG. 5, a subfield is divided into a reset period R, an address-sustain mixed interval T1, a common sustain interval T2, and a brightness correction interval T3. A dotted block denotes an address period in the address-sustain mixed interval T1. A left-hatched block denotes a sustain period in the address-sustain mixed interval T1. A cross-hatched block denotes a sustain period in the common sustain interval T2, and a right-hatched block denotes a sustain period in the brightness correction interval T3.

During the reset period R, which is performed before addressing operations, reset pulses are applied to the scan lines in all groups $G_1$ through $G_n$ to initialize wall charges in all cells. Since the reset period R is performed throughout the panel, uniform and desired wall charge distribution may be accomplished. In other words, reset period R provides substantially uniform wall charges among all cells before the address-sustain mixed interval T1.

During a first address period $A_{G1}$ of the address-sustain mixed interval T1, a scan pulse is sequentially applied to a first scan electrode $Y_{11}$, through a last scan electrode $Y_{1m}$ in a first group $G_1$. After the cells in the first group $G_1$ are addressed, a first sustain period $S_{11}$ is performed to provoke a sustain discharge in the addressed cells using a predetermined number of sustain pulses.

After the first sustain period $S_{11}$ for the first group $G_1$ ends, an address period $A_{G2}$ is performed on cells included in a second group $G_2$. During the address period $A_{G2}$, operation pulses may not be applied to cells in the other groups.

After the address period $A_{G2}$ for the second group $G_2$ finishes, a first sustain period $S_{21}$ for the second group $G_2$ starts. A second sustain period $S_{12}$ for the first group $G_1$, which was addressed previously, may also be performed. However, if a desired gray scale is achieved with the first sustain period $S_{11}$ for the first group $G_1$, the second sustain period $S_{12}$ for the first group $G_1$ may not be performed. At this time, un-addressed cells remain idle.

After the first sustain period $S_{21}$ for the second group $G_2$ finishes, an address period $A_{G3}$ and a first sustain period $S_{31}$ for the third group $G_3$ are performed in the same manner as described above. During the first sustain period $S_{31}$ for the third group $G_3$, sustain periods $S_{13}$ and $S_{22}$ may be performed on the first and second groups $G_1$ and $G_2$ that were previously is addressed. However, if a desired gray scale is achieved with the first sustain periods $S_{11}$ and $S_{21}$1 for the first and second groups $G_1$ and $G_2$, the additional sustain periods $S_{13}$ and $S_{22}$ may not be performed.

With such operations, the scan pulse is sequentially applied to scan electrodes included in the last group $G_n$ during an address period $A_{Gn}$, and thereafter, a sustain period $S_{n1}$ is performed on the last group $G_n$. While the sustain period $S_{n1}$ for the last group $G_n$ is performed, sustain periods for other groups may also be performed.

Referring to FIG. 5, while a sustain period is performed on cells in one group, cells in other groups that have been addressed may also be subjected to the sustain period. Assuming that the number of sustain pulses is the same among unit sustain periods, and brightness obtained from a unit sustain period is uniform, cells in the first group $G_1$ will have "n" times higher brightness than cells in the n-th group $G_1$ Similarly, cells in the second group $G_2$ will have "n−1" times higher brightness than the cells in the n-th group $G_n$. Cells in the (n−1)-th group $G_{n-1}$ will have twice higher brightness than the cells in the n-th group $G_n$. The brightness correction interval T3, which is an additional sustain period, may be used to correct this brightness difference among the groups $G_1$ through $G_n$.

During the brightness correction interval T3, selectively performing a sustain period on groups $G_1$ through $G_n$ may provide a uniform gray scale representation by the cells in the groups.

During the common sustain interval T2, sustain pulses are simultaneously applied to all of the cells on the panel during a predetermined period of time. The common sustain interval T2 may be selectively performed when conditions of a gray scale allocated to each subfield are not satisfied with the address-sustain mixed interval T1 or the address-sustain mixed interval T1 and the brightness correction interval T3. The common sustain interval T2 may be performed after the address-sustain mixed interval T1, as shown in FIG. 5, or it may be performed after the brightness correction interval T3.

The common sustain interval T2 and the brightness correction interval T3 may be selectively performed in a subfield according to a gray scale allocated to the subfield. When a low gray scale is allocated to the subfield, it should have a relatively short sustain period. Conversely, when a high gray scale is allocated to the subfield, it should have a relatively long sustain period. Accordingly, a subfield for a low gray scale may include only the address-sustain mixed interval T1, while a subfield for a high gray scale may include the address-sustain mixed interval T1, the common sustain interval T2, and the brightness correction interval T3. A subfield for a medium gray scale may include the address-sustain mixed interval T1 and the brightness correction interval T3, but not the common sustain interval T2.

FIG. 5 shows a case where a high gray scale allocated to the subfield. Since the groups $G_1$ through $G_n$ have differing length of sustain periods, an additional sustain period may be selectively performed on those groups to provide a uniform gray scale representation throughout the panel. Specifically, cell brightness in the first group $G_1$ is determined by adding the sustain periods $S_{11}$ through $S_{1n}$ performed on the first group $G_1$ during the address-sustain mixed interval T1 and the common sustain interval T2. It is highest at the beginning of the brightness correction interval T3. So that cells in groups $G_2$ through $G_n$ have the same brightness as the cells in group $G_1$, an additional sustain period $S_{2,n}$, corresponding to the first sustain period $S_{11}$ for the first group $G_1$, is performed on the cells in the second group $G_2$. Additional sustain periods $S_{3,n-1}$ and $S_{3,n}$, corresponding to the first and second sustain periods $S_{11}$, and $S_{12}$ for the first group $G_1$, are performed on the cells in the third group $G_3$. Additional sustain periods $S_{n2}$, $S_{n3}$, . . . , $S_{n,n}$ are performed on the cells in the last group $G_n$ in this manner. With such operations, all panel cells may represent uniform brightness.

A single subfield operation is completed after all of the panel cells are finished with the sustain period, and a subsequent subfield then begins with a reset period.

In FIG. 5, "S" denotes a sustain discharge section, and progress from the reset period R to an end of the address-sustain mixed interval T1 may be expressed as $R \rightarrow A_{G1} \rightarrow S \rightarrow A_{G2} \rightarrow S \rightarrow A_{G3} \rightarrow S \rightarrow \ldots \rightarrow S \rightarrow A_{Gn} \rightarrow S$. In other words, after the single reset period R, address periods $A_{G1}$ through $A_{Gn}$ for the groups $G_1$ through $G_n$ are sequentially performed. As progress advances away from the reset period R, that is, as the progress approaches the address period $A_{Gn}$, the probability of an error occurring in an addressing operation increases, notwithstanding the fact that the reset period provided for uniform wall charges for all panel cells. Error probability increases because wall charges in an un-addressed group of cells degrade while addressing and sustain discharges are alternately performed.

Figure 6:
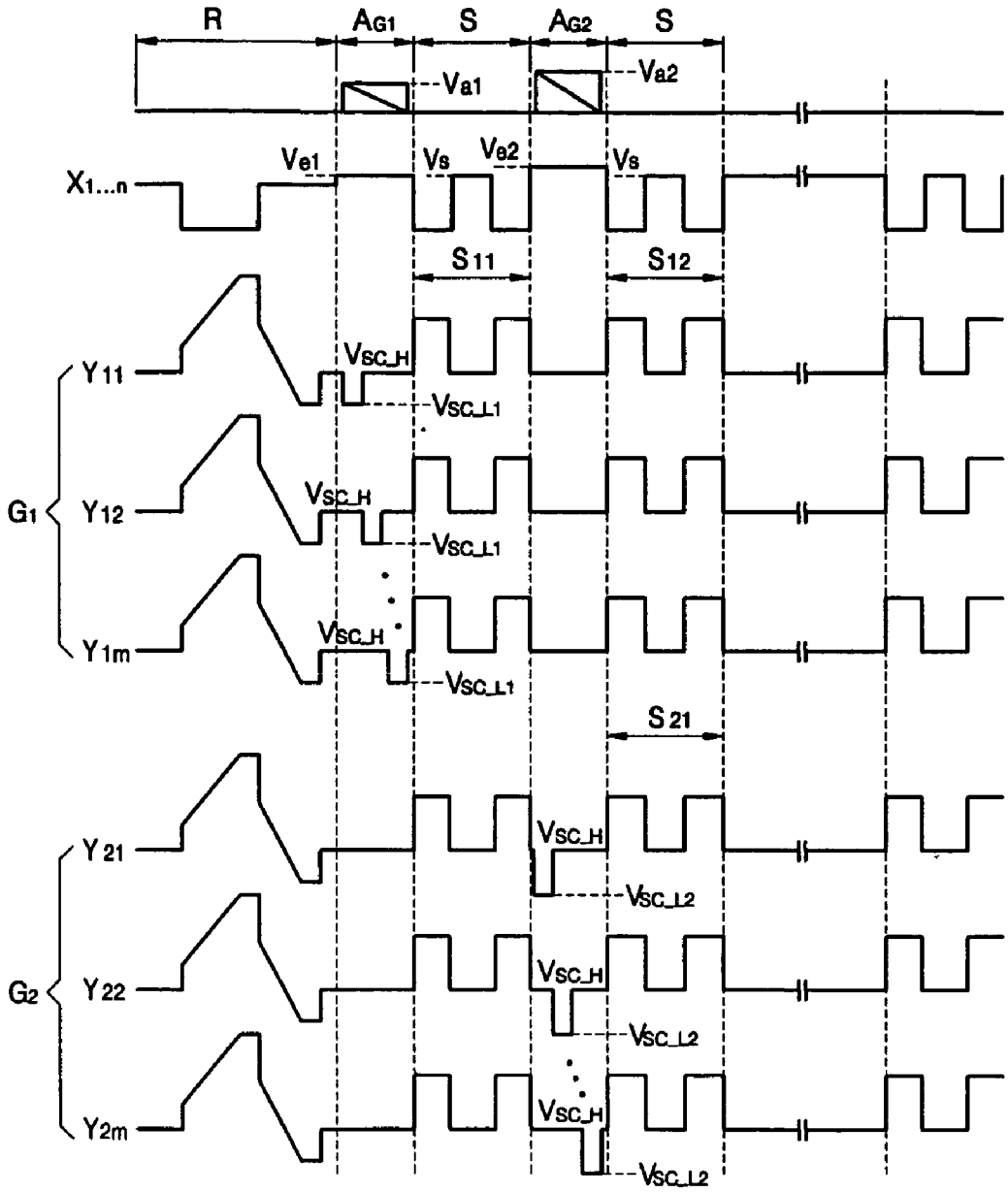
FIG. 6 is a timing chart of a panel driving method according to an exemplary embodiment of the present invention.

FIG. 6 is a timing chart of the panel driving method illustrated in FIG. 5 that is applied to an AC type PDP according to an exemplary embodiment of the present invention. For clarity of the description, scan electrodes $Y_{11}$ through $Y_{2m}$ are classified into two groups $G_1$ and $G_2$, and two different bias voltages $V_{e1}$ through $V_{e2}$ are applied to common electrodes $X_{1 \ldots n}$ during the address periods $A_{G1}$ and $A_{G2}$, respectively, for the groups $G_1$ and $G_2$.

During the reset period R, a reset pulse is alternately applied to the common electrodes $X_{1 \ldots n}$ and the scan electrodes $Y_{11}$ through $Y_{2m}$, to remove sustain discharges and form address discharge conditions.

Next, the address period $A_{G1}$ for the first group $G_1$ is performed. During the address period $A_{G1}$, the bias voltage $V_{e1}$ is applied to the common electrodes $X_{1 \ldots n}$. Simultaneously, the scan electrodes $Y_{11}$ through $Y_{1m}$ and address electrodes (not shown), which define cells to be displayed in the first group $G_1$, are turned on, thereby selecting display cells. After the address period $A_{G1}$ for the first group $G_1$, a sustain pulse $V_s$ is alternately applied to the common electrodes $X_{1 \ldots n}$ and the scan electrodes $Y_{11}$ through $Y_{2m}$, thereby performing a sustain discharge (corresponding to the sustain period $S_{11}$) for the first group $G_1$. After the sustain period $S_{11}$, the address period $A_{G2}$ for the second group $G_2$ is performed. The second group $G_2$ includes "m" scan electrodes $Y_{21}$ through $Y_{2m}$. After the address period $A_{G2}$, the sustain pulse $V_s$ is alternately applied to the common electrodes $X_{1 \ldots n}$ and the scan electrodes $Y_{11}$ through $Y_{2m}$, thereby performing sustain discharges (corresponding to the sustain periods $S_{12}$ and $S_{21}$) for the first and second groups $G_1$ and $G_2$. During the address period $A_{G2}$, the bias voltage $V_{e2}$ is applied to the common electrodes $X_{1 \ldots n}$, and the scan electrodes $Y_{21}$ through $Y_{2m}$. Simultaneously, the address electrodes, which define cells to be displayed in the second group $G_2$, are turned on, thereby selecting display cells. Here, the bias voltage $V_{e1}$ is applied to the common electrodes $X_1$ through $X_n$ during the address period $A_{G1}$ for the first group $G_1$, and the bias voltage $V_{e2}$ is applied to the common electrodes $X_1$ through $X_n$ during the address period $A_{G2}$ for the second group $G_2$. The bias voltages $V_{e1}$ and $V_{e2}$ may be the same or different. Wall charge conditions change during the address period $A_{G1}$ for the first group $G_1$ and during the address period $A_{G2}$ for the second group $G_2$. In particular, a wall charge margin is decreased during the address period $A_{G2}$. Accordingly, if the bias voltages $V_{e1}$ and $V_{e2}$ are the same, addressing errors have a higher probability of occurring in the address period $A_{G2}$ than in the address period $A_{G1}$. This problem may be overcome by applying different bias voltages to the groups $G_1$ and $G_2$, during the address periods $A_{G1}$ and $A_{G2}$. Preferably, $V_{e1}$ is less than $V_{e2}$.

Addressing error probability is higher in a lower portion (i.e., the second group $G_2$) of the panel than in an upper portion because a priming effect of plasma produced during the reset period R decreases as time lapses. Accordingly, in the panel's lower portion, addressing conditions become more unfavorable. Thus, a probability of low discharges increases in the panel's lower portion.

Display cells are addressed due to a difference between an address data's high level potential and a scan pulse's low level potential. Accordingly, a decrease in density of priming particles produced by a reset discharge may be compensated for by increasing the difference between the address data's high level potential and the scan pulse's low level potential. Referring to FIG. 6, this may be accomplished when an address voltage $V_{a2}$ during the address period $A_{G2}$ is set higher than an address voltage $V_{a1}$ during the address period $A_{G1}$. Additionally, this compensation may be accomplished when a low level potential $V_{SC_L2}$ of the scan pulse during the address period $A_{G2}$ is set lower than a low level potential $V_{SC_L1}$ of the scan pulse during the address period $A_{G1}$.

Figure 7A:
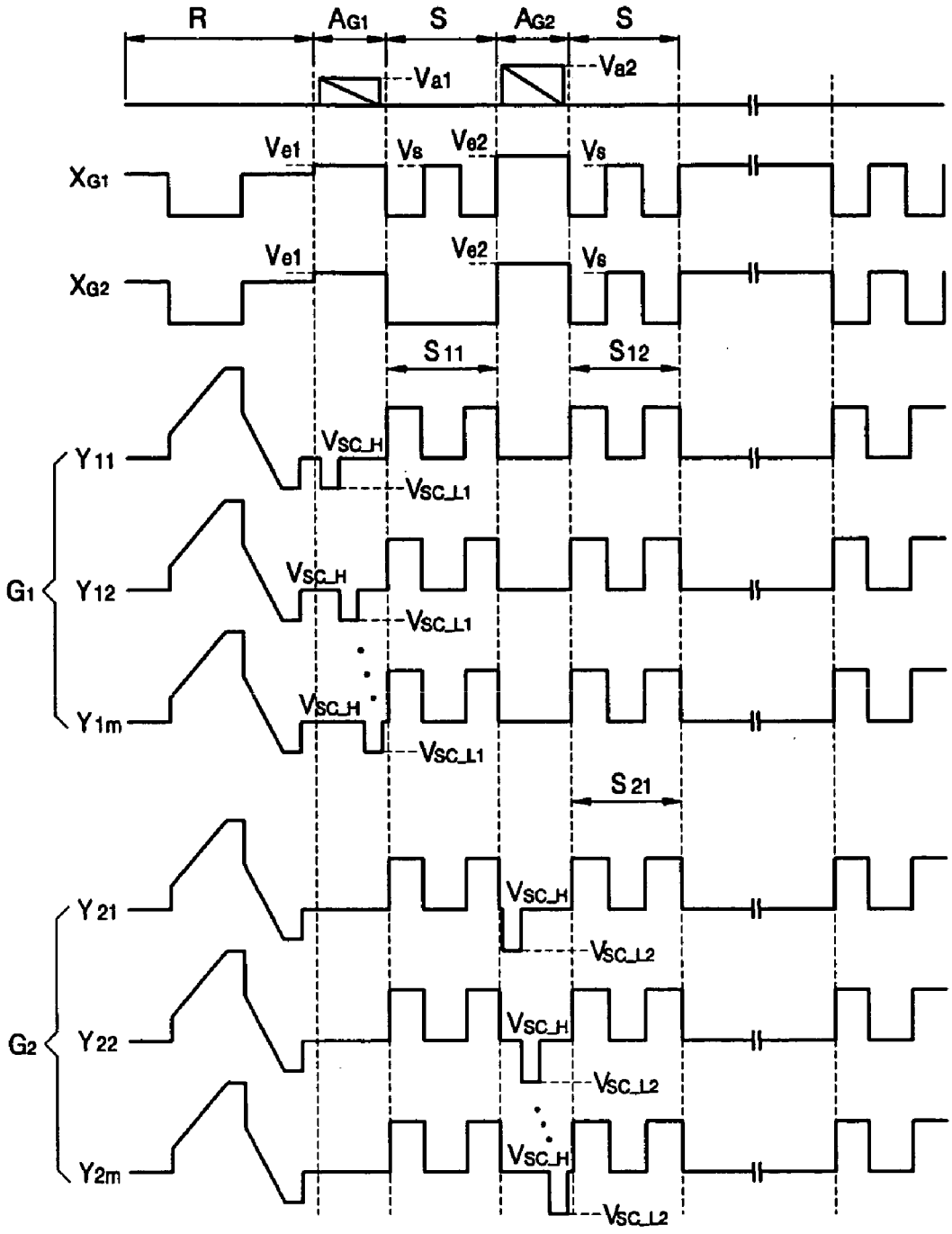
FIG. 7A is a timing chart of a panel driving method according to an exemplary embodiment of the present invention.
Figure 7B:
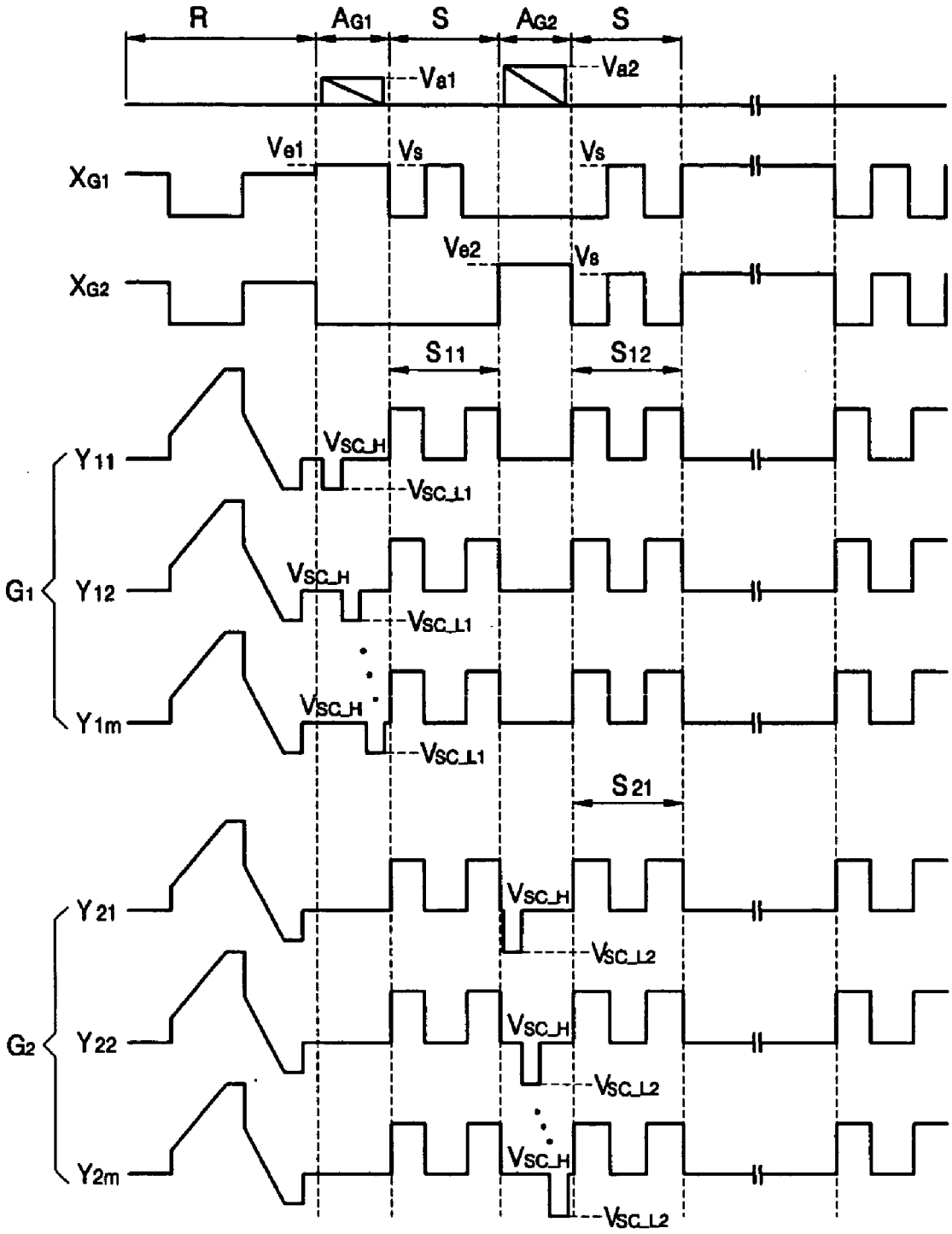
FIG. 7B is a timing chart of a panel driving method according to an exemplary embodiment of the present invention.

FIGS. 7A and 7B are timing charts of the panel driving method, illustrated in FIG. 5, that may be applied to an AC type PDP according to other exemplary embodiments of the present invention. In these embodiments, scan electrode groups may be driven by different common electrode groups.

Referring to FIG. 7A, bias voltages $V_{e1}$ and $V_{e2}$, where $V_{e1}$ is less than $V_{e2}$, are applied to common electrode groups $X_{G1}$, and $X_{G2}$ during address periods $A_{G1}$, and $A_{G2}$, respectively. During a reset period R, a reset pulse is alternately applied to common electrodes of groups $X_{G1}$, and $X_{G2}$ and scan electrodes $Y_{11}$ through $Y_{2m}$, thereby removing sustain discharges and forming wall charge conditions.

Next, the address period $A_{G1}$ for the first scan electrode group $G_1$ is performed. During the address period $A_{G1}$, the bias voltage $V_{e1}$ is applied to the common electrode groups $X_{G1}$ and $X_{G2}$. Simultaneously, the scan electrodes $Y_{11}$, through $Y_{1m}$ and the address electrodes, which define cells to be displayed in the first scan electrode group $G_1$, are turned on, thereby selecting display cells. After the address period $A_{G1}$, for the first scan electrode group $G_1$, a sustain pulse $V_s$ is alternately applied to the common electrodes included in the common electrode groups $X_{G1}$ and $X_{G2}$ and the scan electrodes $Y_{11}$ through $Y_{2m}$, thereby performing a sustain discharge (corresponding to the sustain period $S_{11}$) for the first scan electrode group $G_1$. A sustain discharge does not occur in the second scan electrode group $G_2$, which has not yet been addressed. After the sustain period $S_{11}$ for the first scan electrode group $G_1$, the address period $A_{G2}$ for the second scan electrode group $G_2$ is performed. The second scan electrode group $G_2$ includes "m" scan electrodes $Y_{21}$ through $Y_{2m}$. After the address period $A_{G2}$, the sustain pulse $V_s$ is alternately applied to the common electrodes of groups $X_{G1}$, and $X_{G2}$ and the scan electrodes $Y_{11}$ through $Y_{2m}$, thereby performing sustain discharges (corresponding to the sustain periods $S_{12}$ and $S_{21}$) for the first and second scan electrode groups $G_1$ and $G_2$. During the address period $A_{G2}$, the bias voltage $V_{e2}$ is applied to the common electrode groups $X_{G1}$, and $X_{G2}$. Also, the scan electrodes $Y_{21}$ through $Y_{2m}$ and the address electrodes, which define cells to be displayed in the second scan electrode group $G_2$, are simultaneously turned on, thereby selecting display cells. The bias voltage $V_{e1}$ is applied to the common electrode groups $X_{G1}$, and $X_{G2}$ during the address period $A_{G1}$, but the bias voltage $V_{e2}$ is applied to them during the address period $A_{G2}$ for the second scan electrode group $G_2$.

The bias voltages $V_{e1}$ and $V_{e2}$ may be the same or different. Wall charge conditions simultaneously formed on all panel cells by the reset period R change during the address period $A_{G1}$ for the first scan electrode group $G_1$ and during the address period $A_{G2}$ for the second scan electrode group $G_2$. In particular, a wall charge margin decreases during the address period $A_{G2}$. Accordingly, if the bias voltages $V_{e1}$ and $V_{e2}$ are equal, a higher probability of an addressing error exists in the address period $A_{G2}$ than the address period $A_{G1}$. Applying different bias voltages to the scan electrode groups $G_1$ and $G_2$, during the address periods $A_{G1}$ and $A_{G2}$, may overcome this problem. In other words, the bias voltages are set so that $V_{e1}$ is less than $V_{e2}$, which may compensate for a decreased wall charge margin.

Referring to FIG. 7B, a bias voltage is applied to only an actually addressed common electrode group. As shown in FIG. 7B, a bias voltage $V_{e1}$ may be applied to only a first common electrode group $X_{G1}$ during an address period $A_{G1}$, and a bias voltage $V_{e2}$ is applied to only a second common electrode group $X_{G2}$ during an address period $A_{G2}$.

As described with reference to FIG. 6, it is necessary to compensate for a decrease over time in a density of priming particles produced by a reset discharge in a lower portion (i.e., the second scan electrode group $G_2$) of the panel. This compensation may be accomplished when an address voltage $V_{a2}$ during the address period $A_{G2}$ is higher than an address voltage $V_{a1}$ during the address period $A_{G1}$. Additionally, setting a low level potential $V_{SC_L2}$ of the scan pulse during the address period $A_{G2}$ lower than a low level potential $V_{SC_L1}$ of the scan pulse during the address period $A_{G1}$ may accomplish this compensation.

Figure 8:
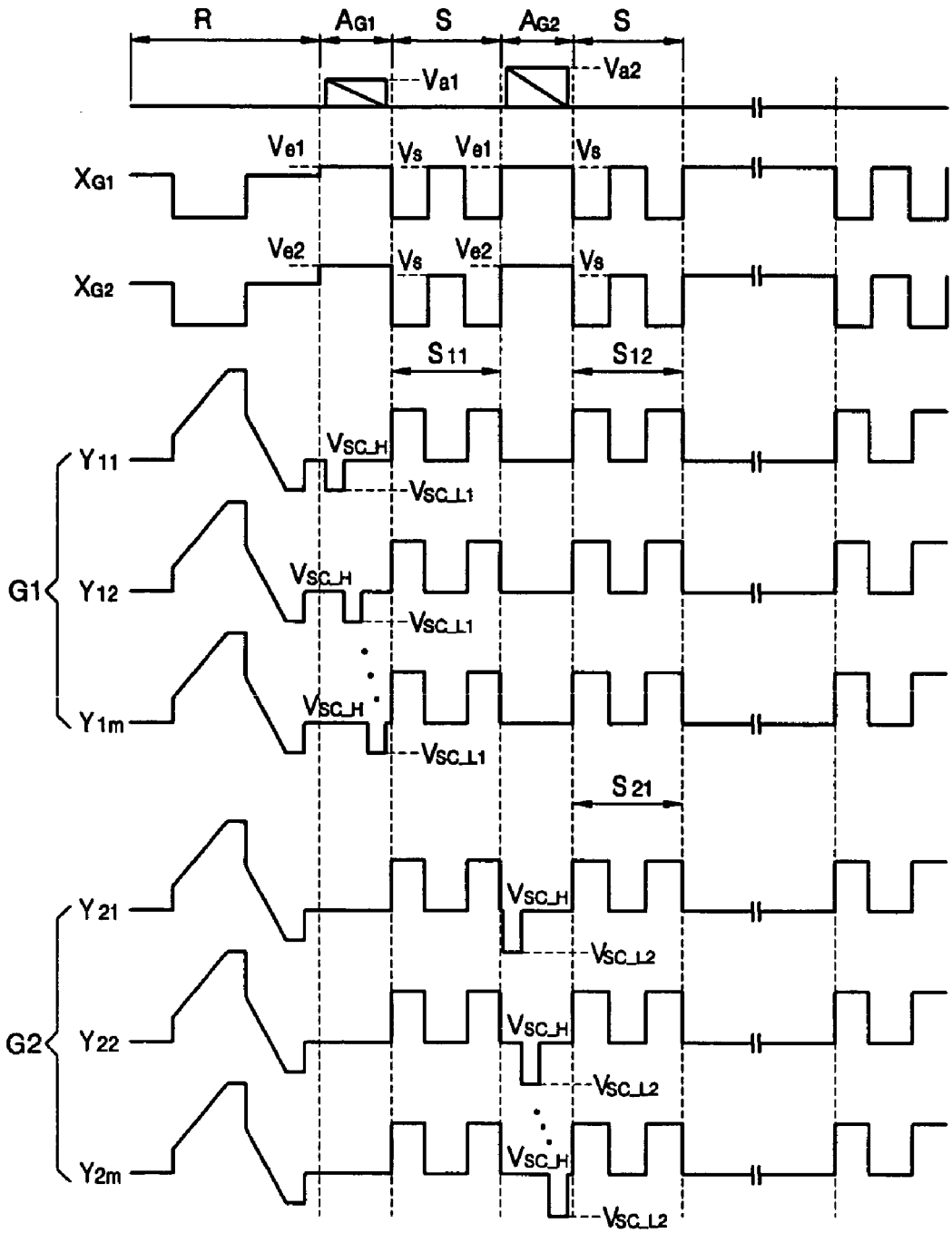
FIG. 8 is a timing chart of a panel driving method according to an exemplary embodiment of the present invention.

FIG. 8 is a timing chart of the panel driving method, illustrated in FIG. 5, that is applied to an AC type PDP according to another exemplary embodiment of the present invention. In this exemplary embodiment, different common electrode groups drive scan electrode groups, and different bias voltages are applied to the common electrode groups.

During a reset period R, a reset pulse is alternately applied to common electrodes included in common electrode groups $X_{G1}$ and $X_{G2}$, and scan electrodes $Y_{11}$ through $Y_{2m}$, thereby removing sustain discharges and forming uniform wall charge conditions.

Next, an address period $A_{G1}$, for a first scan electrode group $G_1$ is performed. During the address period $A_{G1}$, a first bias voltage $V_{e1}$ is applied to a first common electrode group $X_{G1}$, and a second bias voltage $V_{e2}$ is applied to a second common electrode group $X_{G2}$. Additionally, scan electrodes $Y_{11}$ through $Y_{1m}$ and address electrodes (not shown), which define cells to be displayed in the first scan electrode group $G_1$, are simultaneously turned on, thereby selecting display cells. After the address period $A_{G1}$, a sustain pulse $V_s$ is alternately applied to the common electrodes of common electrode groups $X_{G1}$, and $X_{G2}$ and the scan electrodes $Y_{11}$ through $Y_{2m}$, thereby performing a sustain discharge (corresponding to the sustain period $S_{11}$) for the first scan electrode group $G_1$. After the sustain period $S_{11}$, an address period $A_{G2}$ for a second scan electrode group $G_2$ is performed. After the address period $A_{G2}$, the sustain pulse $V_s$ is alternately applied to the common electrodes of common electrode groups $X_{G1}$ and $X_{G2}$ and the scan electrodes $Y_{11}$ through $Y_{2m}$, thereby performing sustain discharges (corresponding to the sustain periods $S_{12}$ and $S_{21}$) for the first and second scan electrode groups $G_1$ and $G_2$. During the address period $A_{G2}$, the first bias voltage $V_{e1}$ is applied to the first common electrode group $X_{G1}$, and the second bias voltage $V_{e2}$ is applied to the second common electrode group $X_{G2}$. Additionally, the scan electrodes $Y_{21}$ through $Y_{2m}$ and the address electrodes, which define cells to be displayed in the second scan electrode group $G_2$, are simultaneously turned on, thereby selecting display cells. The different bias voltages $V_{e1}$ and $V_{e2}$ are applied to the common electrode groups $X_{G1}$ and $X_{G2}$, respectively, regardless of the address periods $A_{G1}$ and $A_{G2}$.

The bias voltages $V_{e1}$ and $V_{e2}$ may be the same or different. Wall charge conditions simultaneously formed on all panel cells by the reset period R change during the address period $A_{G1}$ for the first scan electrode group $G_1$ and during the address period $A_{G2}$ for the second scan electrode group $G_2$. In particular, a wall charge margin decreases during the address period $A_{G2}$. Accordingly, if the bias voltages $V_{e1}$ and $V_{e2}$ are equal, a higher probability of an addressing error exists in the address period $A_{G2}$ than the address period $A_{G1}$. Applying different bias voltages to the scan electrode groups $G_1$ and $G_2$, during the address periods $A_{G1}$ and $A_{G2}$, may overcome this problem. In other words, the bias voltages are set so that $V_{e1}$ is less than $V_{e2}$, which may compensate for a decreased wall charge margin.

As described with reference to FIG. 6, it is necessary to compensate for a decrease over time in a density of priming particles produced by a reset discharge in a lower portion (i.e., the second scan electrode group $G_2$) of the panel. This compensation may be accomplished when an address voltage $V_{a2}$ during the address period $A_{G2}$ is higher than an address voltage $V_{a1}$ during the address period $A_{G1}$. Additionally, setting a low level potential $V_{SC_L2}$ of the scan pulse during the address period $A_{G2}$ lower than a low level potential $V_{SC_L1}$ of the scan pulse during the address period $A_{G1}$ may accomplish this compensation.

In the exemplary embodiments illustrated in FIGS. 6 through 8, applying different bias voltages to common electrodes during address periods for different scan electrode groups may compensate for a difference in a wall charge margin during an address period among scan electrode groups.

In the exemplary embodiments illustrated in FIGS. 6 through 8, for description clarity purposes, three sustain pulses are generated during a sustain period. Actually, it is preferable to generate many sustain pulses to substantially provoke sustain discharges in addressed cells. For example, when a 256 gray scale gradation is implemented, many sustain pulses are generated during a sustain period.

In the exemplary embodiments illustrated in FIGS. 6 through 8, after the address period $A_{G1}$ and the sustain period $S_{11}$ for the first scan electrode group $G_1$ end, the address period $A_{G2}$ and the sustain period $S_{21}$ for the second scan electrode group $G_2$ are performed. While the sustain period $S_{21}$ for the second scan electrode group $G_2$ is performed, the sustain period $S_{12}$ for the first scan electrode group $G_1$ is also performed. The sustain period $S_{11}$ may not have the same time length and number of scan pulses as the sustain periods $S_{12}$ or $S_{21}$.

The structure and operations of an apparatus using the panel driving method illustrated in FIG. 5 will be described with reference to FIG. 3 below. Referring back to FIG. 3, an addressing and a sustain discharge are performed on cells on the panel 312 using the signal combiner 306, the Y-driver 308, and the X-driver 310.

The panel driving apparatus shown in FIG. 3 classifies the cells on the panel 312 into a plurality of groups, and performs an addressing and a sustain discharge on cells included in each group. The signal combiner 306 sequentially performs an address period and a sustain period. It generates an address signal and a sustain signal such that while cells included in one group are addressed, cells included in the others are idle, and while a sustain period is performed on cells included in one group after being addressed, the sustain period is selectively performed on cells included in other previously addressed groups.

In response to the address signal, the Y-driver 308 applies a scan pulse to scan electrodes of each group, thereby performing the address period. Also, an address pulse is applied to address electrodes. While the Y-driver 308 sequentially addresses the groups in response to the address signal, the X-driver 310 applies different bias voltages to common electrodes during address periods for different scan electrode groups to compensate for a wall charge margin decrease. After all groups have been addressed, the Y-driver 308 and the X-driver 310 alternately apply a sustain pulse to the cells included in each group in response to the sustain signal, thereby performing the sustain period.

After performing the address period on the cells of all groups, the signal combiner 306 may generate another sustain signal, in a common sustain interval, to perform the sustain period on all panel cells during a predetermined period of time according to a subfield's allocated gray scale. Additionally, the signal combiner 308 may also generate another sustain signal, in a brightness correction interval, to selectively perform the sustain period on cells so that all of the cells on the panel 312 have uniform brightness.

The present invention may be applied to any display apparatus that sequentially performs an address period, for selecting display cells to be turned on, and a sustain period for provoking the selected cells to emit light. For example, the present invention may also be applied to a direct current (DC) type PDP, an electroluminescent (EL) display apparatus, and an apparatus such as a liquid crystal display, which displays an image by sequentially performing the address period and the sustain period using space charges.

The present invention may also be embodied as computer readable codes on a computer readable recording medium. The computer readable recording medium may be any data storage device that can store a program or data that can be thereafter read by a computer system. Examples of the computer readable recording medium include read-only memory (ROM), random-access memory (RAM), CD-ROMs, magnetic tapes, hard disks, floppy disks, flash memory, and optical data storage devices. In this case, the program stored in a recording medium is composed of a series of commands directly or indirectly used within an apparatus, such as a computer, that has information processing capability to obtain a predetermined result. Accordingly, the term "computer" encompasses every apparatus that includes memory, an input/output unit, and an arithmetic unit and has the information processing capability to perform a predetermined function according to a program. Accordingly, a panel driving apparatus is substantially a sort of computer that is limited to a special field, i.e., panel driving.

In the present invention, a signal combiner included in a panel driving apparatus is implemented by an integrated circuit (IC) including memory and a processor, and therefore, a program for performing a method of driving a panel may be stored in the memory. When the panel driving apparatus drives the panel, the program stored in the memory is executed to perform an addressing and a sustain discharge according to exemplary embodiments of the present invention. Accordingly, the IC storing the program for performing the panel driving method will be considered as a sort of recording medium.

In particular, the panel driving method may be created via schematic and VHSIC hardware description language (VHDL) on a computer and implemented via a programmable IC, e.g., a filed programmable gate array (FPGA), connected to the computer. The recording medium includes such programmable IC.

As described above, in a panel driving method according to exemplary embodiments of the present invention, cells on a panel are classified into a plurality of groups, and an address period and a sustain period are sequentially performed on each group during a subfield period. Accordingly, once a cell is addressed, a sustain discharge is provoked in the cell shortly thereafter. Therefore, even if a scan pulse width and an address pulse width, which are generated during the address period, are narrowed, a reliable sustain discharge may be obtained. As a result, a time required to address the panel cells is reduced, and thus more time may be allocated to the sustain discharge during a single TV field period. Accordingly, displayed image brightness may be increased, and a high gray scale may be represented on a large panel including many scan lines. Additionally, the present invention allows a subfield to be optimally driven according to a gray scale allocated thereto.

In performing the panel driving method according to exemplary embodiments of the present invention, different bias voltages may be applied to common electrodes during address periods for different groups in a single subfield. Use of the different bias voltages during the address periods for the different groups may prevent wall charge conditions formed in the cells by a reset operation from degradation while the addressing and sustain discharges are alternately performed. As a result, the cells may be more reliably addressed.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A panel driving apparatus that performs an addressing and a sustain discharge on a panel including a plurality of scan electrode groups and one or more common electrode groups, comprising:

a subfield processor dividing a frame period into a plurality of subfields;

a signal combiner generating an address signal to selectively address cells to be turned on among all cells on the panel in a subfield and generating a sustain signal to perform a sustain discharge in addressed cells; and an electrode driver selectively driving the subfields according to the address signal and the sustain signal and driving each of cell groups to determine a gray scale of brightness of the cells on the panel, wherein the signal combiner sequentially performs an address period and a sustain period on each cell group and generates the address signal and the sustain signal such that while cells included in one cell group are addressed, cells included in the other cell groups are in an idle state and such that while the sustain period is performed on cells included in one cell group after being addressed, the sustain period is selectively performed on cells included in other cell groups having been addressed, and wherein the electrode driver applies different bias voltages for the respective cell groups to the one or more common electrode groups while the address period is sequentially performed on the cell groups.

2. The panel driving apparatus of claim 1, wherein the signal combiner further generates another sustain signal to perform the sustain period on the cells included in all of the cell groups in common during a predetermined period of time according to a gray scale allocated to a subfield in a common sustain interval.

3. The panel driving apparatus of claim 1, wherein the signal combiner further generates another sustain signal to selectively perform the sustain period on cells included in each cell group in a brightness correction interval such that all of the cells on the panel represent a predetermined gray scale allocated to a subfield.

4. A method of driving a panel, comprising:

classifying cells on the panel into a plurality of cell groups;

dividing a frame period into a plurality of subfields;

driving the cell groups using different common electrode groups, respectively; and sequentially performing an address period and a sustain period on the cell groups in at least one subfield to determine a gray scale of brightness of the cells on the panel, wherein after the address period is performed on cells included in a cell group, the sustain period is performed on the cells included in the cell group, wherein after the sustain period is completed on the cell group, the address period is performed on another cell group, wherein while the sustain period is performed on one cell group, the sustain period is selectively performed on other cell groups on which the address period has been performed, and wherein different bias voltages are applied to the common electrode groups, respectively, while the address period is sequentially performed on the cell groups.

5. The method of claim 4, wherein among the different bias voltages applied to the common electrode groups, a bias voltage applied to a common electrode group during a previous address period is lower than a bias voltage applied to another common electrode group during a subsequent address period.

6. The method of claim 4, further comprising performing the sustain period on all of the cell groups in common for a predetermined period of time in a common interval.

7. The method of claim 4, further comprising selectively performing the sustain period on the cell groups in a correction interval to make the cells on the panel represent a predetermined gray scale allocated to the subfield.

8. The method of claim 4, wherein while the address period is sequentially performed on the cell groups, an address voltage applied to address electrodes during a previous address period is lower than an address voltage applied to address electrodes during a subsequent address period.

9. The method of claim 4, wherein while the address period is sequentially performed on the cell groups, a low level potential of a scan pulse applied to scan electrodes included in a previous cell group is higher than a low level potential of a scan pulse applied to scan electrodes included in a subsequent cell group.

10. A method of driving a display apparatus, comprising:

classifying cells on a panel into a plurality of cell groups;

dividing a frame period into a plurality of subfields; and sequentially performing an address period and a sustain period on the cell groups in at least one subfield to determine a gray scale of brightness of the cells on the panel, wherein after cells included in one of the plurality of cell groups are addressed, the cells included in one of the plurality of cell groups are sustain-discharged, wherein after one of the plurality of cell groups are sustain-discharged, another of the plurality of cell groups is addressed, wherein while one of the plurality of cell groups is sustain-discharged, others of the plurality of cell groups that have been addressed are selectively sustain-discharged, and wherein bias voltages applied to common electrodes while the address period is sequentially performed on the cell groups are different among the plurality of cell groups.

11. The method of claim 10, wherein when applying different bias voltages among the cell groups, a bias voltage applied during a previous address period is lower than a bias voltage applied during a subsequent address period.

12. The method of claim 10, further comprising simultaneously performing the sustain period on all of the cell groups for a predetermined period of time.

13. The method of claim 10, further comprising selectively performing the sustain period on the cell groups to make the cells on the panel represent a predetermined gray scale allocated to the subfield.

14. The method of claim 10, wherein while the address period is sequentially performed on the cell groups, an address voltage applied to address electrodes during a previous address period is lower than an address voltage applied to address electrodes during a subsequent address period.

15. The method of claim 10, wherein while the address period is sequentially performed on the cell groups, a low level potential of a scan pulse applied to scan electrodes included in a previous cell group is higher than a low level potential of a scan pulse applied to scan electrodes included in a subsequent cell group.

16. A method for driving a display apparatus, comprising:

classifying cells on a panel into a plurality of cell groups;

dividing a frame period into a plurality of subfields;

driving each cell group using a different common electrode group; and sequentially performing an address period and a sustain period on the cell groups in at least one subfield to determine a gray scale of brightness of the cells on the panel, wherein after performing the address period on cells included in a cell group, the sustain period is performed on the cells included in the cell group, wherein after completing the sustain period on the cell group, the address period is performed on another cell group, wherein while the sustain period is performed on one cell group, the sustain period is selectively performed on other cell groups on which the address period has been performed, and wherein bias voltages applied to the common electrode groups while the address period is sequentially performed on the cell groups are different among the cell groups.

17. The method of claim 16, wherein when applying different bias voltages, among the cell groups, to the common electrode groups, a bias voltage applied during a previous address period is lower than a bias voltage applied during a subsequent address period.

18. The method of claim 16, wherein a bias voltage is applied to only a common electrode group that is driving a current group of cells on which the address period is being performed.

19. The method of claim 16, further comprising simultaneously performing the sustain period on all of the cell groups for a predetermined period of time.

20. The method of claim 16, further comprising selectively performing the sustain period on the cell groups to make the cells on the panel represent a predetermined gray scale allocated to the subfield.

21. The method of claim 16, wherein while the address period is sequentially performed on the cell groups, an address voltage applied to address electrodes during a previous address period is lower than an address voltage applied to address electrodes during a subsequent address period.

22. The method of claim 16, wherein while the address period is sequentially performed on the cell groups, a low level potential of a scan pulse applied to scan electrodes included in a previous cell group is higher than a low level potential of a scan pulse applied to scan electrodes included in a subsequent cell group.

* * * * *